United States Patent [19]

George

[11] Patent Number: 4,783,921

[45] Date of Patent: Nov. 15, 1988

[54] MOUNTING ARRANGEMENT FOR WIND-DEFLECTABLE BENDING SIGN

[75] Inventor: Gary P. George, St. Louis County, Mo.

[73] Assignee: Stout Industries, Inc., St. Louis, Mo.

[21] Appl. No.: 64,544

[22] Filed: Jun. 22, 1987

[51] Int. Cl.[4] ..... G09F 7/00

[52] U.S. Cl. ..... 40/602; 40/607; 40/612

[58] Field of Search ..... 40/602, 606, 607, 612

[56] References Cited

U.S. PATENT DOCUMENTS

| | | | |
|---|---|---|---|
| Re. 32,359 | 2/1987 | Seely | 40/606 |
| 2,557,399 | 6/1951 | Teetor | 40/19 R |
| 3,422,556 | 1/1969 | Lyons | 40/10 R |
| 3,525,493 | 8/1970 | Crietzberg | 40/606 |
| 4,595,802 | 6/1986 | Field | 40/10 D |

*Primary Examiner*—Gene Mancene

*Assistant Examiner*—Wenceslao J. Contreras

*Attorney, Agent, or Firm*—Kalish & Gilster

[57] ABSTRACT

A wind resistant sign for display purposes includes a base and a resilient panel having a base portion supported by the base for extending outwardly from the base in a direction perpendicular to the base, the panel being thin and of such resilience and strength as to undergo bending deflection responsive to wind forces. First and second oppositely disposed mounting members of the base are clamped together by screw and nut fasteners to define between the members a throat for receiving the panel base portion. The throat opens upwardly on opposite faces of the panel in smoothly outwardly diverging relationship to the panel with radius of curvature much less than the natural bending radius of curvature of the panel to provide a strain-relieving support on opposite faces of the panel when undergoing bending deflection.

5 Claims, 1 Drawing Sheet

MOUNTING ARRANGEMENT FOR WIND-DEFLECTABLE BENDING SIGN

BACKGROUND AND SUMMARY OF THE INVENTION

This invention relates to display devices and, more particularly, to an improved mounting arrangement for a display sign of the type which undergoes bending deflection in response to wind forces, which mounting arrangement permits the sign to have an increased life by making possible a greater number of bending cycles without failure.

In a known bendable sign of the above character, a panel of the sign is caused to bend without elastic deformation in response to forces of wind impinging upon the panel. For example, such a sign may be base-mounted so that the panel normally stands erect, i.e., is perpendicular to ground surface. Rectangular, elongated base members clamp marginal portions of a base portion of the panel to maintain this relationship. In response to wind, the sign bends increasingly with increasing wind velocity until the panel is nearly bent over until nearly horizontal under high wind conditions. The panel deflection imposes high strains upon the base portion of the panel by which the panel is supported and disposed for normal usage. If the panel is deflected through a sufficient number of bending cyles over a sufficient period, such as during many months and even years of use, the bending strain strain ultimately may cause the panel base portion, by which it is attached, to rupture and fail.

Accordingly, it is an object of the present invention to provide a mounting for such a wind-deflectable bending sign which will prevent failure of the panel base portion by which it is supported; which will provide strain-relieving support on opposite faces of the panel when undergoing bending and deflection to permit a far greater number of bending cycles than heretofore to assure of many years of operation without failure; which does not complicate the construction of the sign, being readily incorporated into existing sign configurations, and which does not present an unattractive appearance or otherwise interfere with normal functioning of the sign. It is also an object of the present invention to provide a very expedient, low-cost strain relief for the base portion of the panel and to contribute a construction which facilitates the assembly of the sign during manufacture.

Other objects and features will be in part apparent and in part pointed out hereinbelow.

Briefly, a wind resistant sign for which the present invention is intended includes a base and a resilient panel having a base portion supported by the base for extending outwardly from the base in a direction perpendicular to the base. The panel is thin and of such resilience and strength as to undergo bending deflection relative to the base in response to forces of wind impinging upon the panel. The new mounting arrangement comprises first and second mounting members of the base, the mounting members together defining a throat for receiving the panel base portion, and securement means extending through the panel base portion and the first and second mounting members to clamp the panel base portion and first and second mounting members in clamped relationship. The throat opening extends upwardly on opposite faces of the panel in smoothly, outwardly diverging relationship to the panel, whereby to provide a strain-relieving support on opposite faces of the panel as it bends.

DESCRIPTION OF THE PREFERRED EMBODIMENTS

Figure 1:
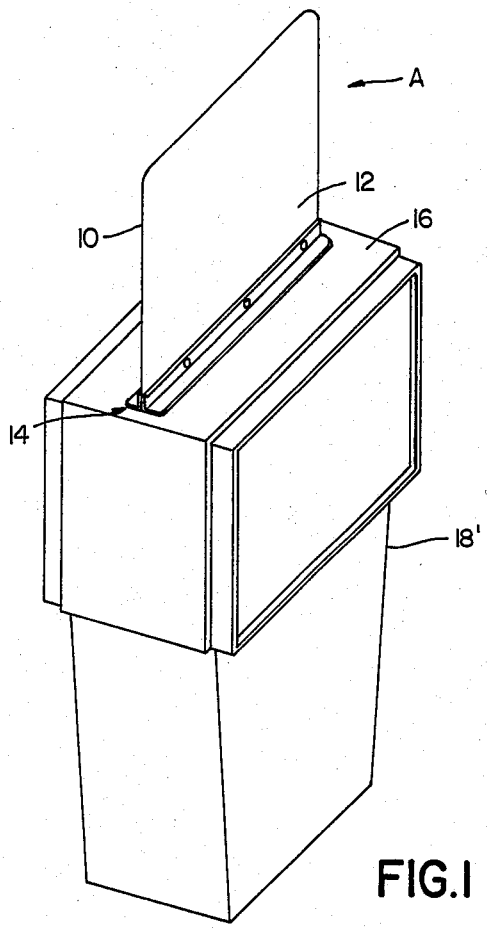
FIG. 1 is a perspective view of a wind-deflectable bending sign constructed in accordance with and embodying the present invention.

Referring to FIG. 1, a wind-resistant sign is generally designated at A. Sign A includes a resilient panel 10 having a base portion 12 which is supported by a base designated in its entirely by 14. The base is shown representatively seated upon the top 16 of an automotive fuel pump 18, to which it may be secured by any conventional means, if desired, such as by fasteners, adhesives or magnets. In any event, panel 10 extends vertically upwardly, that is outwardly, from base 14 in a direction perpendicular to the base and so also to pump 10.

Panel 10, being unitary, is thin and of sufficient resilience and strength such that it may undergo extreme bending deflection in response to wind forces impinging upon the sign. Thus, panel 10 may be regarded as a resilient fascia. For example, it may be of the highly resilient aluminum alloy as disclosed in George U.S. patent application Ser. No. 06/672,905, filed Nov. 19, 1984, now abandoned, herein incorporated by reference.

Bending of panel 10 permits sign A to withstand high winds, such as of speeds more than 50 m.p.h., instead of being overturned, laterally shifted, displaced from its normal location in use, or otherwise damaged by the wind forces.

Figure 2:
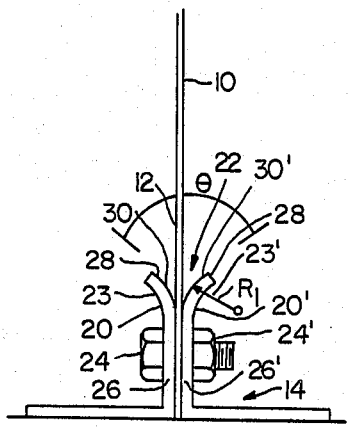
FIG. 2 is an enlarged fragmentary end elevational view of the sign of FIG. 1.

Referring to FIG. 2, base 14 comprises first and second mounting bracket members 20, 20' oppositely disposed on the opposite faces of panel 10 for receiving base portion 12 between them in clamped relationship. Together, base members 20, 20' define a throat 22 into which base portion is readily inserted during manufacture. Each of the members 20, 20' has a respective vertical flange 23, 23' for forming said throat 22. Bolts and nuts, as at 24, 24' may be provided at intervals along the lengths of the bracket members for extending through respective vertical inner portions 26, 26' of the upstanding flanges thereof, to serve as securement means for maintaining the clamped relationship securely and tightly. The bracket members include horizontal base flanges 28, 28', forming an angle of substantially 90° with the vertical inner flange portions 26, 26'.

The vertical flanges 23, 23' of the base members have outer portions 28, 28' which form outward curved surfaces. Said surfaces as shown at 30, 30' are curved about a relatively short radius $R_1$ such as about 3/8 in. It is evident from FIG. 2 that said curves surfaces 30, 30' diverge smoothly from the panel faces.

Figure 4:
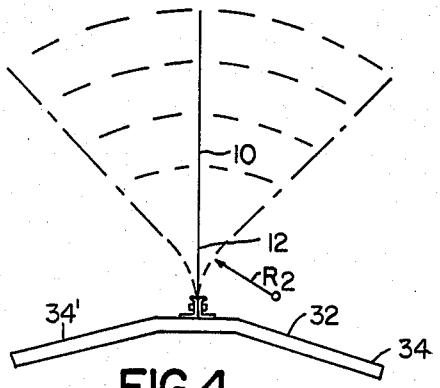
FIG. 4 is an end elevational view thereof.

However, said bending deflection (as shown in FIG. 4) of the lower panel portion 12 provides a natural bending radius $R_2$ of curvature of about 6 in. Thus, the panel radius of curvature $R_2$ is always substantially larger than the radius $R_1$ of the curved portions 30, 30'. Thus, $R_2/R_1$ is approximately 16. Because of the curvature of the outer flange portions, the base portion 12 does not encounter any sharp edge or other discontinuity as it bends, even severely, so that there is always a strain-relieving support on the opposite panel faces in said base portion 12, when the panel is bent. It is preferred that the throat defined by the outward divergence subtend an angle, $\theta$, substantially 90°, and such is found to be entirely sufficient for achieving bending strain relief even when the panel is bent over by wind pressure to the point of being almost parallel with the ground surface.

Members 20, 20' are most preferably of 14 gauge steel, but may be of aluminum or plastic; or may be metal coated with plastic. In any event, the length of each of members 20, 20' must be the same, i.e., at least as great as the dimension of panel 10 between side edges so that the entire panel width will be provided with strain relief as it bends, as test data provided hereinbelow indicates that if the panel width is greater than the base member support, premature breakage of the panel can result.

Figure 3:
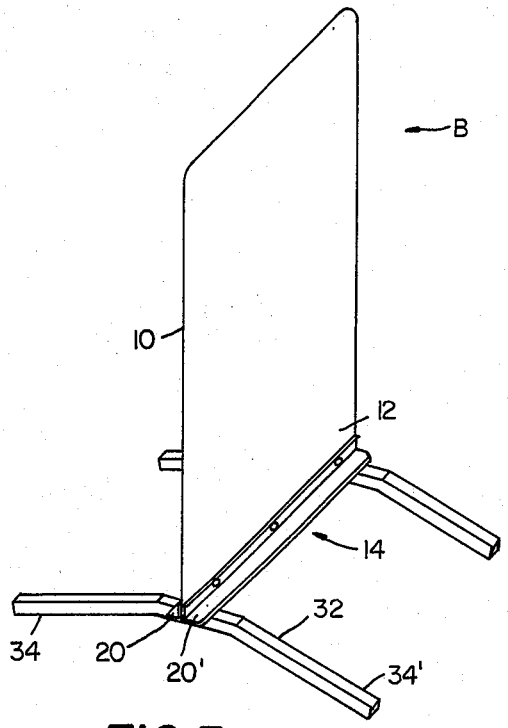
FIG. 3 is a perspective view of another embodiment of a wind-deflectable sign incorporating the invention.

FIG. 3 illustrates a version B of the sign wherein panel 10 extends several feet above ground surface. The panel is supported by said base members 20, 20' which are in turn affixed to base legs 32 at opposite ends, the base legs having outer ends 34, 34' angled slightly downwardly so as to space the lower end of a panel 10 a few inches above ground surface. This is not necessary for aerodynamic reasons, but instead prevents the lower end of the sign from being hidden in tall grass and also provides ground clearance for placement in rough locations, such as on uneven ground or rocky soil.

Figure 5:
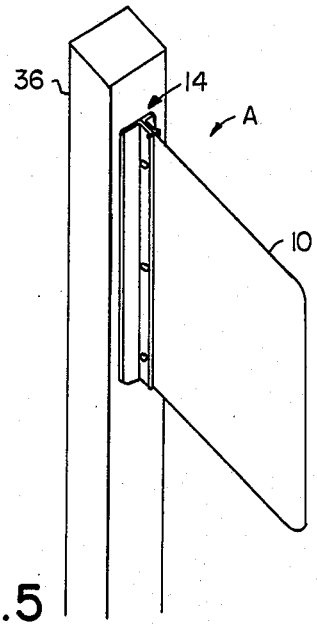
FIG. 5 is a prospective view illustrating a way of mounting the sign for use.

FIG. 5 demonstrates the use of embodiment A by securement of the base 14 to a vertical support 36 which might be, for example, a wooden post, light standard, canopy support or any other vertical structure. In such usage, the sign panel 10 bends in response to wind from side to side. The strain-relieving base support enables the number of bending cycles to be greatly increased in such usage in the same way it does in the embodiments demonstrated in FIGS. 1 and 3.

Data have been taken to compare a bending sign of bending type, such as that disclosed in said application Ser. No. 06/672,905, as against a pending sign according to the present invention. Said data demonstrate that the present sign with such an improved base mounding providing strain relief according to the invention will have a lifetime for this sign greatly in excess of the conventional configuration, typically four times the normally expected lifetime, and thus estimated to be eight years of use without failure.

The following table summarizes data for several test sequences intended to show comparison between a conventional configuration without strain relief and an improved configuration having the strain-relieving base support configuration of the invention. The data were obtained by use of a test rig in which any two sign constructions were mounted side by side. A cable cylinder pulled the two sign panels back and forth to simulate wind gusts. A counter was attached to record the number of cycles, a single cycle being one complete backward deflection followed by one complete forward deflection. The test sequences used various materials and base support configuration as shown in the notes to the table.

TABLE

| TEST SEQUENCES | | | | | | |
|---|---|---|---|---|---|---|
| TEST SEQUENCE NUMBER | PANEL ALLOY TYPE | PANEL WIDTH (in.) | BASE MEMBER LENGTH (in.) | BASE MEMBER TYPE | CYCLES UNTIL FAILURE | MODE OF FAILURE |
| 1 | 5052 | 24 | 21 | 1 | 8,300 | bad fracture |
| 1 | 5052 | 24 | 21 | 2 | 8,300 | hairline |
| 2 | 3004 | 24 | 21 | 1 | 1,296 | bad |
| 2 | 5052 | 24 | 21 | 2 | 1,296 | O.K. |
| 3 | 5052 | 24 | 21 | 1 | 3,400 | fracture |
| 3 | 5052 | 24 | 21 | 3 | 3,400 | fracture |
| 4 | 5052 | 24 | 21 | 1 | 5,846 | bad |
| 4 | 5052 | 24 | 21 | 4 | 5,846 | bad |
| 5 | 5052 | 24 | 21 | 1 | 5,000 | very bad |
| 5 | 5052 | 24 | 24 | 5 | 8,000 | fracture |
| 6 | 5052 | 24 | 21 | 1 | 7,500 | bad |
| 6 | 5052 | 24 | 21 | 2 | 12,670 | very bad |
| 7 | 5052 | 24 | 21 | 1 | 9,975 | very bad |
| 7 | 5052 | 24 | 24 | 6 | 23,000 | very bad |
| 8 | 5052 | 24 | 24 | 5 | 10,400 | fail |
| 8 | 5052 | 24 | 24 | 6 | 37,250 | fail |
| 9 | 5052 | 24 | 24 | 5 | 10,650 | fail |
| 9 | 5052 | 24 | 24 | 6 | 50,200 | fail |

NOTES:
1 Formed 14 gauge steel angles 21 in. l. × 1.0 in. h. × 1.5 in. w.
2 Formed 14 gauge steel angles 21 in. l. × 1.5 in. h. × 1.5 in. w. edge as per invention.
3 Formed 14 gauge steel angles 21 in. l. × 1.0 in. h. × 1.5 in. w. with top two corners rounded.
4 Formed 14 gauge steel angles 21 in. l. × 1.0 in. h. × 1.5 in. w. with "POLYSOL" plastic dip-coating.
5 Formed 14 gauge steel angles 24 in. l. × 1.0 in. h. × 1.5 in. w.
6 Formed 14 gauge steel angles 24 in. l. × 1.5 in. h. × 1.5 in. w. with outward curve at top as shown in FIG. 2 according to this invention.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. In a wind resistant sign for display purposes including a base and a resilient planar panel having a base portion supported by the base for extending outwardly from the base in a direction perpendicular to the base, the base formed of first and second mounting members, means for securing the mounting members together with the panel base portion received between the mounting members, the panel being thin and of such resilience and strength as to undergo repeated bending deflection relative to the base in response to forces of wind upon the panel, a breakage resistance improvement comprising:

a. each of said first and second mounting members having a respective throat-forming outer portion, b. each said throat-forming portion being curved outwardly from the plane of the panel to form a curved surface diverging smoothly from the plane of the panel, c. there being curved inner surfaces of each said outwardly curved throat-forming portion which inner surfaces do not contact the panel faces when the panel is not undergoing bending deflection but which inner surfaces provide strain-relieving curved support for the panel faces when the panel is undergoing repeated bending deflection in response to wind, d. the length of the first and second mounting members being at least as great as the width of the panel base portion, whereby the panel base portion is prevented from breaking for a high number of bending cycles as said panel undergoes bending deflection in response to wind.

2. In a wind resistant sign according to claim 1, the base members each comprising at least an upstanding flange, the breakage resistance improvement further characterized by e. the flange having a first, inner portion having a face parallel to and lying against a marginal region of the panel base portion, f. said throat-forming outer portion extending upwardly and outwardly from the inner portion to define for said curved throat-forming portion a curvature of constant radius $R_1$ which departs from the plane of the panel, g. the panel when undergoing bending deflection in response to wind defining a natural bending radius of curvature $R_2$, and h. $R_2$ being much greater than $R_1$.

3. In a wind resistant sign according to claim 2, the breakage resistance improvement further characterized by the throat-forming outer portion of the flanges of said base members forming between them a throat subtending an angle of substantially 90°.

4. In a wind resistant sign according to claim 2, the breakage resistance improvement further characterized by $R_2/R_1$ being approximately 16.

5. In a wind resistant sign according to claim 2, the breakage resistance improvement further characterized by the panel being of aluminum alloy type 5052.

* * * * *